US011635710B2

(12) United States Patent
Sato et al.

(10) Patent No.: US 11,635,710 B2
(45) Date of Patent: Apr. 25, 2023

(54) IMAGE FORMING APPARATUS INCLUDING TRANSFER DEVICE LOCATED ABOVE PHOTOSENSITIVE DRUM

(71) Applicant: BROTHER KOGYO KABUSHIKI KAISHA, Nagoya (JP)

(72) Inventors: Shougo Sato, Seto (JP); Kazuna Taguchi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/569,037

(22) Filed: Jan. 5, 2022

(65) Prior Publication Data

US 2022/0214633 A1 Jul. 7, 2022

(30) Foreign Application Priority Data

Jan. 6, 2021 (JP) ..... JP2021-000872

(51) Int. Cl.
*G03G 15/08* (2006.01)

(52) U.S. Cl.
CPC ..... *G03G 15/0891* (2013.01); *G03G 15/0886* (2013.01); *G03G 15/0889* (2013.01);
(Continued)

(58) Field of Classification Search
CPC ..... G03G 15/0891; G03G 15/0896; G03G 15/0889; G03G 15/0877; G03G 15/0881; G03G 15/0886; G03G 15/0875; G03G 2215/068; G03G 2215/0692; G03G 2215/0665; G03G 2215/0802;
(Continued)

(56) References Cited

U.S. PATENT DOCUMENTS 6,526,245 B1 * 2/2003 Yamashita ..... G03G 15/0822 399/258
2003/0012589 A1 1/2003 Kanari et al.
(Continued)

FOREIGN PATENT DOCUMENTS

JP 2-62563 U 5/1990
JP 2003-29532 A 1/2003
(Continued)

*Primary Examiner* — Arlene Heredia
*Assistant Examiner* — Laura Roth
(74) *Attorney, Agent, or Firm* — Merchant & Gould P.C.

(57) ABSTRACT

A first development chamber accommodates an agitator. A second development chamber accommodates a development roller and a supply roller. The second development chamber is located above the first development chamber. A toner cartridge contains toner to be supplied to the first development chamber. A transfer device is located above a photosensitive drum in a state where a drum unit is attached to a main housing. The transfer device transfers toner on the photosensitive drum to a sheet. An agitator includes a shaft and a blade. The shaft is rotatably supported by a development housing. The blade is rotatable together with the shaft. The blade has a first end fixed to the shaft and a second end located away from the first end. The agitator is configured such that, when rotated, the second end of the blade reaches a height of an opening in the development housing in a vertical direction.

14 Claims, 12 Drawing Sheets

(52) U.S. Cl.
CPC ..... *G03G 2215/068* (2013.01); *G03G 2215/0665* (2013.01); *G03G 2215/0692* (2013.01); *G03G 2215/0844* (2013.01)

(58) Field of Classification Search
CPC ... G03G 2215/0841; G03G 2215/0844; G03G 2215/085
See application file for complete search history.

(56) References Cited

U.S. PATENT DOCUMENTS

| | | | | |
|---|---|---|---|---|
| 2008/0247784 | A1 | 10/2008 | Kakuta et al. | |
| 2008/0317501 | A1* | 12/2008 | Mase ..... | G03G 15/0867 399/119 |
| 2009/0274491 | A1 | 11/2009 | Sato | |
| 2010/0247156 | A1* | 9/2010 | Awano ..... | G03G 15/0875 399/258 |
| 2012/0148314 | A1* | 6/2012 | Park ..... | G03G 15/0891 399/281 |
| 2013/0028631 | A1* | 1/2013 | Sato ..... | G03G 21/1676 399/110 |
| 2021/0080870 | A1* | 3/2021 | Maeda ..... | G03G 15/0894 |

FOREIGN PATENT DOCUMENTS

| | | | |
|---|---|---|---|
| JP | 2008-170951 | A | 7/2008 |
| JP | 2009-265537 | A | 11/2009 |

* cited by examiner

4K

IMAGE FORMING APPARATUS INCLUDING TRANSFER DEVICE LOCATED ABOVE PHOTOSENSITIVE DRUM

CROSS REFERENCE TO RELATED APPLICATIONS

This application claims priority from Japanese Patent Application No. 2021-000872 filed Jan. 6, 2021. The entire content of the priority application is incorporated herein by reference.

BACKGROUND

Conventionally, an image forming apparatus includes a main housing, a process cartridge, and a transfer device. The process cartridge includes a photosensitive drum and a development device.

SUMMARY

According to one aspect, this specification discloses an image forming apparatus. The image forming apparatus includes a main housing, a drum unit, a toner cartridge and a transfer device. The drum unit is attachable to the main housing. The drum unit includes a photosensitive drum, a development roller, a supply roller, an agitator, and a development housing. The development housing has a first development chamber and a second development chamber. The development housing includes a wall having an opening. The first development chamber and the second development chamber are in communication with each other through the opening. The first development chamber accommodates the agitator. The second development chamber accommodates the development roller and the supply roller. The second development chamber is located above the first development chamber. The toner cartridge is configured to contain toner to be supplied to the first development chamber of the development housing. The toner cartridge is attachable to the main housing. The transfer device is located above the photosensitive drum in a state where the drum unit is attached to the main housing. The transfer device is configured to transfer toner on the photosensitive drum to a sheet. The agitator includes a shaft and a blade. The shaft is rotatably supported by the development housing. The blade is rotatable together with the shaft. The blade has a first end fixed to the shaft and a second end located away from the first end. The agitator is configured such that, when rotated, the second end of the blade reaches a height of the opening in a vertical direction.

According to the above configuration, the toner cartridge containing toner is replaced separately from the drum unit including the photosensitive drum. Further, when the agitator accommodated in the first development chamber rotates, the second end of the blade reaches the height of the opening in the vertical direction. Thus, although the second development chamber accommodating the development roller and the supply roller is located above the first development chamber in a state where the drum unit is attached to the main housing, the agitator supplies toner from the first development chamber to the second development chamber through the opening.

BRIEF DESCRIPTION OF THE DRAWINGS

Embodiments in accordance with this disclosure will be described in detail with reference to the following figures wherein.

DETAILED DESCRIPTION

The transfer device is located above the photosensitive drum in a state where the process cartridge is attached to the main housing. The development device includes a development housing, a development roller, and an agitator. The development housing has a development chamber in which a development roller is arranged and a toner storage chamber in which toner is stored. The toner storage chamber is located at a lower position than the development chamber in a state where the process cartridge is attached to the main housing. The agitator is located in the toner storage chamber, and conveys toner from the toner storage chamber to the development chamber.

In the above image forming apparatus, when the remaining amount of toner in the toner storage chamber becomes low, the entire process cartridge including the photosensitive drum needs to be replaced even if the photosensitive drum does not need to be replaced. With such an image forming apparatus, it is difficult to reduce the usage cost.

In view of the foregoing, an aspect of an object of this disclosure is to provide an image forming apparatus having a configuration that a transfer device is located above a photosensitive drum in a state where a drum unit is attached to a main housing and that a toner cartridge is replaced separately from the drum unit.

1. Image Forming Apparatus 1

An image forming apparatus 1 will be described with reference to FIGS. 1 and 2.

Figure 1:
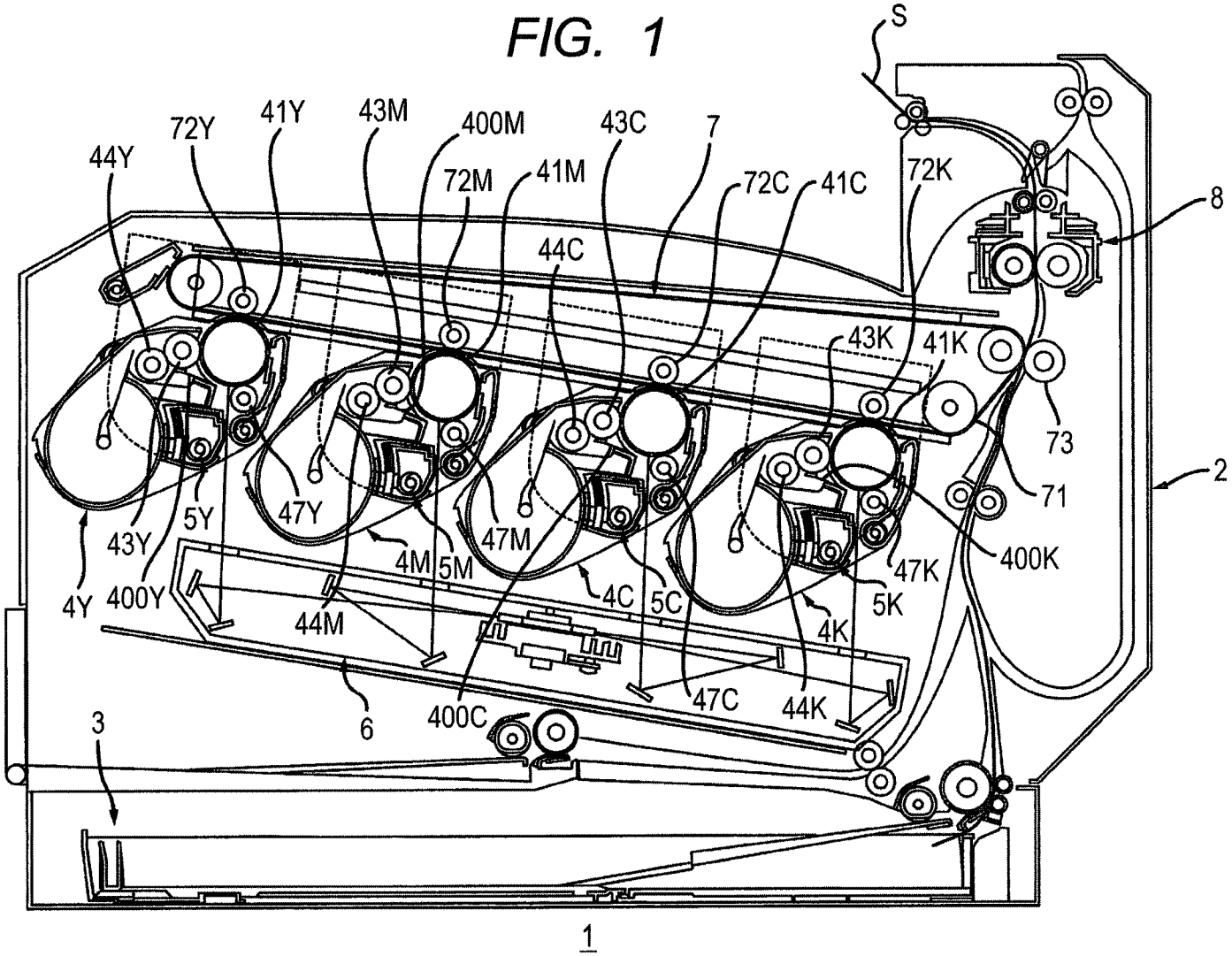
FIG. 1 is a diagram showing a schematic configuration of an image forming apparatus.

As shown in FIG. 1, the image forming apparatus 1 includes a main housing 2, a sheet cassette 3, four drum units 4Y, 4M, 4C, 4K, four toner cartridges 5Y, 5M, 5C, 5K, an exposure device 6, a transfer device 7, and a fixing device 8.

1.1 Main Housing 2

The main housing 2 accommodates the sheet cassette 3, the four drum units 4Y, 4M, 4C, 4K, the four toner cartridges 5Y, 5M, 5C, 5K, the exposure device 6, the transfer device 7, and the fixing device 8.

1.2 Sheet Cassette 3

The sheet cassette 3 accommodates a sheet S. The sheet S in the sheet cassette 3 is conveyed toward a secondary transfer roller 73. The secondary transfer roller 73 will be described later.

1.3 Four Drum Units 4Y, 4M, 4C, 4K

The four drum units 4Y, 4M, 4C, and 4K are attachable to the main housing 2. The four drum units 4Y, 4M, 4C, and 4K have the same configuration as one another. Thus, in the following, the drum unit 4K will be described in detail, and the description of the drum units 4Y, 4M, and 4C will be omitted.

1.3.1 Drum Unit 4K

Figure 2:
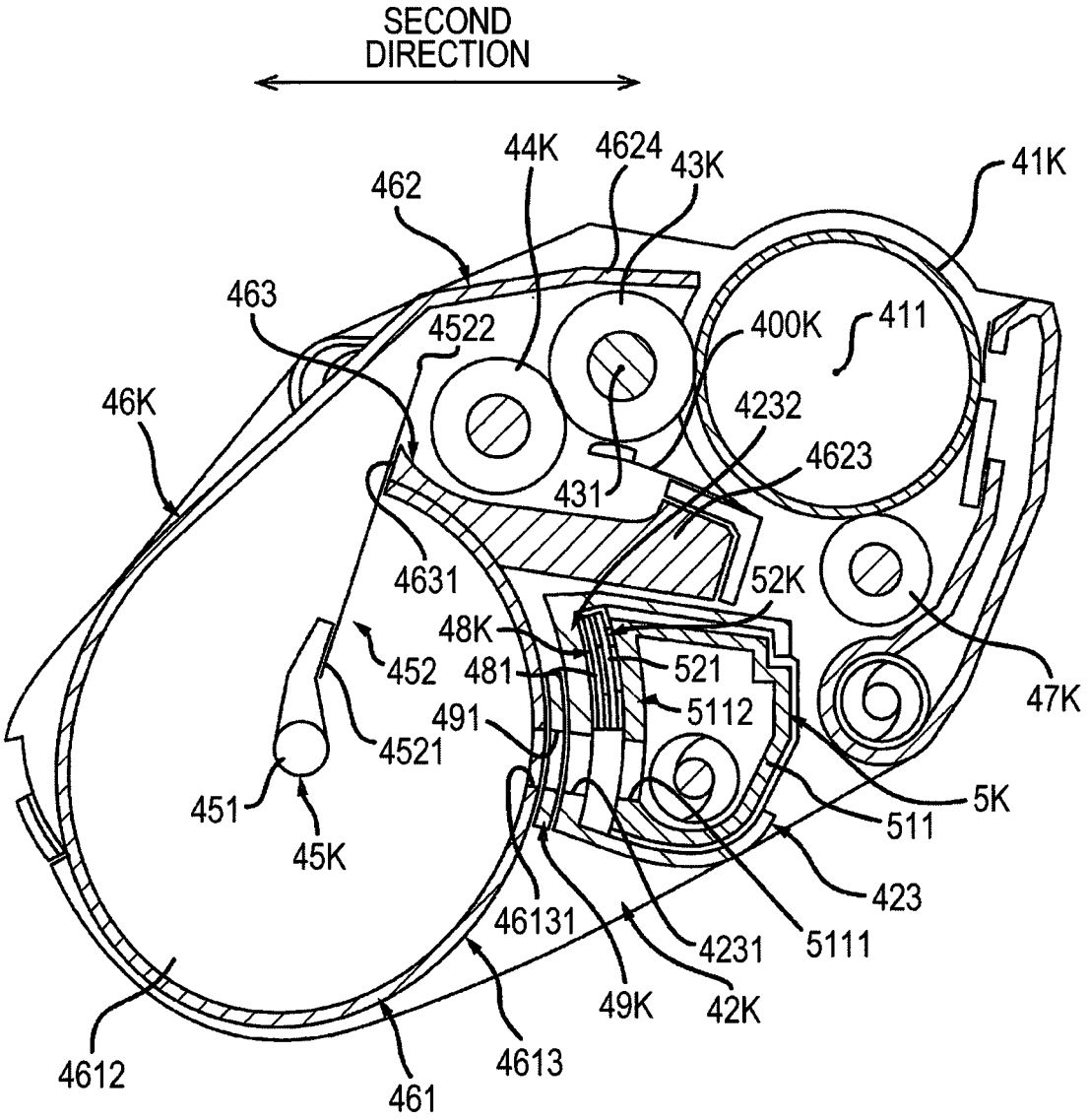
FIG. 2 is an enlarged view of a drum unit shown in FIG. 1 and shows a state where a toner shutter is located at a toner open position.

As shown in FIG. 2, the drum unit 4K includes a photosensitive drum 41K, a charging device 47K, a development roller 43K, a supply roller 44K, and a layer thickness regulating blade 400K.

The photosensitive drum 41K extends in a first direction. The photosensitive drum 41K has a cylindrical shape. The photosensitive drum 41K is rotatable about an axis 411. The axis 411 extends in the first direction. The drum unit 4K is attachable to the main housing 2 in the first direction.

The charging device 47K charges the circumferential surface of the photosensitive drum 41K. Specifically, the charging device 47K is a charging roller. The charging device 47K may be a scorotron type charger.

The development roller 43K supplies toner to the photosensitive drum 41K. The development roller 43K extends in the first direction. The development roller 43K is rotatable about a development axis 431. The development axis 431 extends in the first direction. In this embodiment, the development roller 43K contacts the photosensitive drum 41K. The development roller 43K may be separated from the photosensitive drum 41K at a particular interval.

The supply roller 44K supplies toner to the development roller 43K. The supply roller 44K is located at the opposite side of the photosensitive drum 41K with respect to the development roller 43K. The supply roller 44K extends in the first direction. The supply roller 44K is rotatable about an axis. The axis of the supply roller 44K extends in the first direction.

The layer thickness regulating blade 400K regulates the layer thickness of the toner on the development roller 43K by contacting the circumferential surface of the development roller 43K. The layer thickness regulating blade 400K is located between the photosensitive drum 41K and the supply roller 44K. The layer thickness regulating blade 400K is arranged to contact the development roller 43K from below in a state where the drum unit 4K is attached to the main housing 2. The layer thickness regulating blade 400K extends in the first direction.

1.3.2 Drum Unit 4Y, 4M, 4C

As shown in FIG. 1, the drum unit 4Y includes a photosensitive drum 41Y, a charging device 47Y, a development roller 43Y, a supply roller 44Y, and a layer thickness regulating blade 400Y. The drum unit 4M includes a photosensitive drum 41M, a charging device 47M, a development roller 43M, a supply roller 44M, and a layer thickness regulating blade 400M. The drum unit 4C includes a photosensitive drum 41C, a charging device 47C, a development roller 43C, a supply roller 44C, and a layer thickness regulating blade 400C.

1.4 Four Toner Cartridges 5Y, 5M, 5C, 5K

Four toner cartridges 5Y, 5M, 5C, and 5K are attachable to the main housing 2. More specifically, the toner cartridge 5Y is attachable to the drum unit 4Y. The toner cartridge 5Y stores toner that is supplied to the supply roller 44Y. The toner cartridge 5M is attachable to the drum unit 4M. The toner cartridge 5M stores toner that is supplied to the supply roller 44M. The toner cartridge 5C is attachable to the drum unit 4C. The toner cartridge 5C stores toner that is supplied to the supply roller 44C. The toner cartridge 5K is attachable to the drum unit 4K. The toner cartridge 5K stores toner that is supplied to the supply roller 44K.

1.5 Exposure Device 6

The exposure device 6 exposes the surfaces of four photosensitive drums 41Y, 41M, 41C, and 41K. The exposure device 6 emits light that exposes the charged surfaces of the photosensitive drums 41Y, 41M, 41C, and 41K. As a result, an electrostatic latent image is formed on each surface of the photosensitive drums 41Y, 41M, 41C, and 41K. Toner is supplied to the electrostatic latent image.

The exposure device 6 is located below the four drum units 4Y, 4M, 4C, and 4K. Here, "below" means the lower side in the vertical direction in a state where the image forming apparatus 1 is placed in a normal use state.

Specifically, the exposure device 6 is a laser scan unit. The exposure device 6 may be an LED array.

1.6 Transfer Device 7

The transfer device 7 transfers the toner on the four photosensitive drums 41Y, 41M, 41C, and 41K to the sheet S. The transfer device 7 is located at the opposite side of the exposure device 6 with respect to the four drum units 4Y, 4M, 4C, and 4K. The transfer device 7 is located above the four photosensitive drums 41Y, 41M, 41C, and 41K in a state where the four drum units 4Y, 4M, 4C, and 4K are attached to the main housing 2. The transfer device 7 includes an intermediate transfer belt 71, four primary transfer rollers 72Y, 72M, 72C, 72K, and the secondary transfer roller 73.

In a state where the four drum units 4Y, 4M, 4C, and 4K are attached to the main housing 2, the four photosensitive drums 41Y, 41M, 41C, and 41K are in contact with the intermediate transfer belt 71. In a state where the four drum units 4Y, 4M, 4C, and 4K are attached to the main housing 2, the intermediate transfer belt 71 passes between the photosensitive drum 41Y and the primary transfer roller 72Y, between the photosensitive drum 41M and the primary transfer roller 72M, between the photosensitive drum 41C and the primary transfer roller 72C, and between the photosensitive drum 41K and the primary transfer roller 72K.

The primary transfer roller 72Y transfers the toner on the photosensitive drum 41Y to the intermediate transfer belt 71. The primary transfer roller 72M transfers the toner on the photosensitive drum 41M to the intermediate transfer belt 71. The primary transfer roller 72C transfers the toner on the photosensitive drum 41C to the intermediate transfer belt 71. The primary transfer roller 72K transfers the toner on the photosensitive drum 41K to the intermediate transfer belt 71.

The secondary transfer roller 73 contacts the intermediate transfer belt 71. The sheet S conveyed from the sheet cassette 3 passes between the intermediate transfer belt 71 and the secondary transfer roller 73. At this time, the secondary transfer roller 73 transfers the toner transferred to the intermediate transfer belt 71 to the sheet S.

1.7 Fixing Device 8

The fixing device 8 heats and pressurizes the sheet S on which toner is transferred to fix the toner on the sheet S. The sheet that has passed through the fixing device 8 is discharged to the upper surface of the main housing 2.

2. Details of the Drum Unit 4K

Next, the details of the drum unit 4K will be described with reference to FIGS. 2 to 8.

As shown in FIG. 2, the drum unit 4K includes a drum frame 42K, a first coupling 40K (see FIG. 5), a development housing 46K, an agitator 45K, a development shutter 48K, and a cushion member 49K, in addition to the photosensitive drum 41K, the charging device 47K, the development roller 43K, the supply roller 44K, and the layer thickness regulating blade 400K described above.

2.1 Drum Frame 42K

The drum frame 42K supports the photosensitive drum 41K, the charging device 47K, and the development housing 46K.

Figure 4:
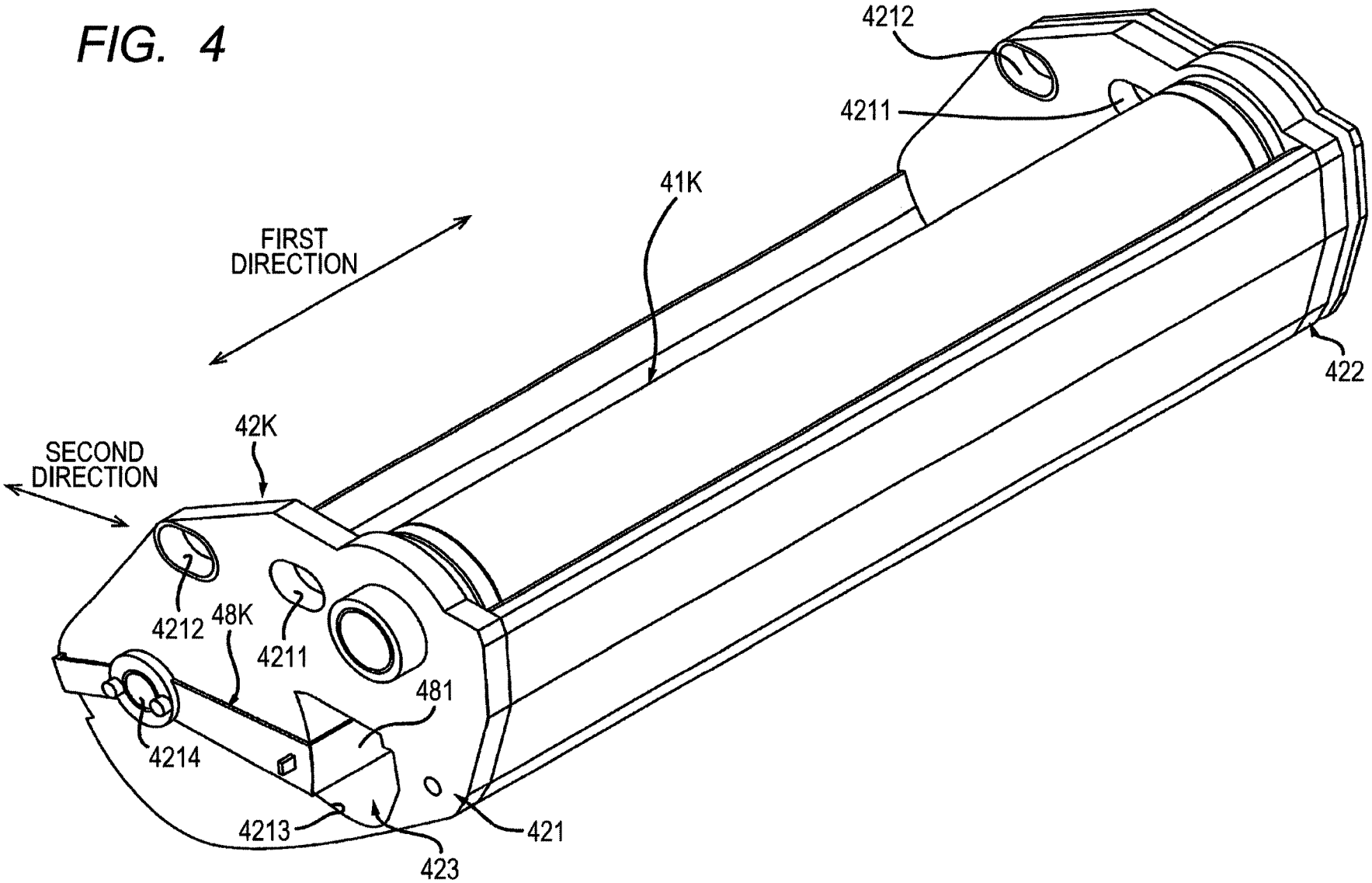
FIG. 4 is a perspective view of the drum unit shown in FIG. 2, showing a state where a development housing is removed.

As shown in FIG. 4, the drum frame 42K includes a first side frame 421, a second side frame 422, and a receiving portion 423.

2.1.1 First Side Frame 421 and Second Side Frame 422

The first side frame 421 supports one end of the photosensitive drum 41K in the first direction. The second side frame 422 is separated from the first side frame 421 in the first direction. The second side frame 422 supports an other end of the photosensitive drum 41K in the first direction.

The first side frame 421 extends in a second direction. The second direction crosses the first direction. The first side frame 421 includes a first elongated hole 4211, a second elongated hole 4212, and a hole 4213.

The first elongated hole 4211 extends in a direction in which the photosensitive drum 41K and the development roller 43K face each other (see FIG. 2). A first protrusion 464A fits in the first elongated hole 4211 (see FIG. 6). The first protrusion 464A will be described later.

The second elongated hole 4212 is located at the opposite side of the photosensitive drum 41K with respect to the first elongated hole 4211 in the second direction. The second elongated hole 4212 extends in a direction parallel to a direction in which the first elongated hole 4211 extends. A second protrusion 465A fits in the second elongated hole 4212. The second protrusion 465A will be described later.

In a state where the drum unit 4K is attached to the main housing 2, the hole 4213 is located below the photosensitive drum 41K. In a state where the toner cartridge 5K is attached to the main housing 2, a first portion 511 of the toner cartridge 5K passes through the hole 4213 (see FIG. 2).

The first side frame 421 includes a first boss 4214.

The first boss 4214 supports the development shutter 48K so as to be rotatable. The first boss 4214 is separated from the hole 4213 in the second direction. In a state where the drum unit 4K is attached to the main housing 2, the first boss 4214 is located below the second elongated hole 4212. The first boss 4214 has a circular columnar shape. The first boss 4214 extends from a side surface of the first side frame 421 in the first direction.

Figure 6:
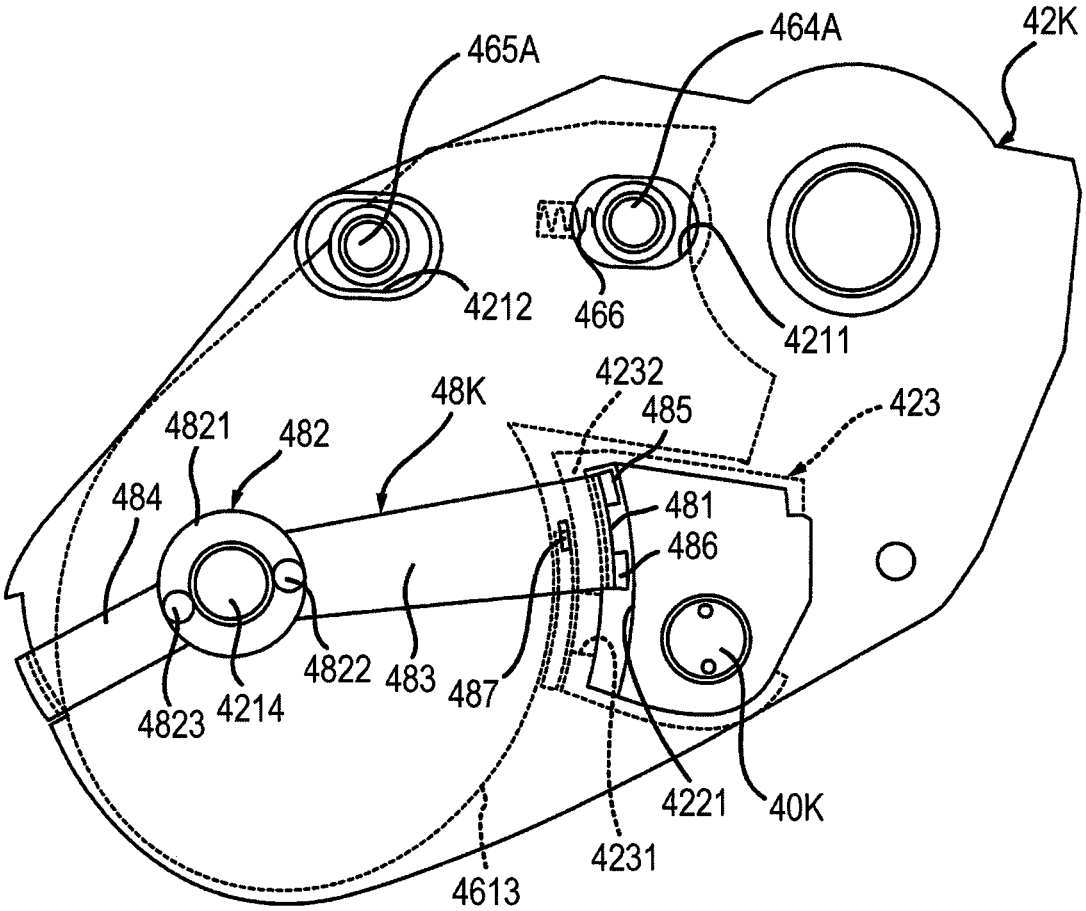
FIG. 6 is a side view of the drum unit shown in FIG. 4, showing a state where the development shutter is located at a development open position.

The description of the first side frame 421 is applied in the same way to the second side frame 422 except that the second side frame 422 includes a slit 4221 (see FIG. 6) instead of the hole 4213. Thus, the description of the second side frame 422 will be omitted. As shown in FIG. 6, the slit 4221 communicates with the internal space of the receiving portion 423. The slit 4221 extends in an arc-like shape.

2.1.2 Receiving Portion 423

As shown in FIG. 2, in a state where the toner cartridge 5K is attached to the main housing 2, the receiving portion 423 receives the first portion 511 of the toner cartridge 5K.

The receiving portion 423 faces a first development chamber 461 of the development housing 46K in the second direction. In a state where the drum unit 4K is attached to the main housing 2, the receiving portion 423 is located below a second development chamber 462 of the development housing 46K. The first development chamber 461 and the second development chamber 462 will be described later.

Figure 5:
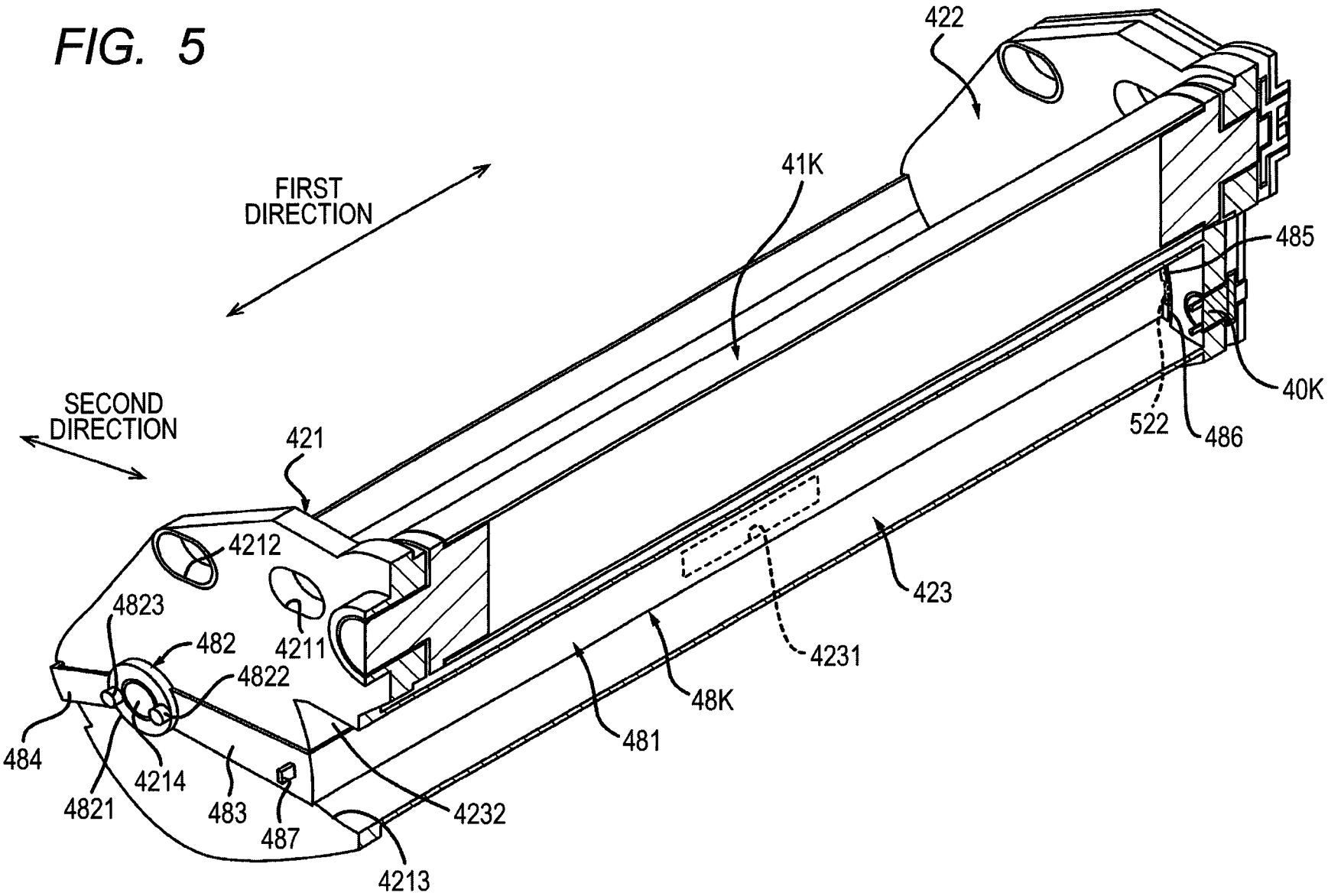
FIG. 5 shows a perspective cross-sectional view of the drum unit shown in FIG. 4.

The receiving portion 423 includes a first wall 4232. The first wall 4232 faces a connecting wall 4613 of the first development chamber 461 in the second direction. The first wall 4232 has an arc-like shape extending along an outer peripheral surface of the connecting wall 4613. The connecting wall 4613 will be described later. The first wall 4232 includes a communication port 4231. In other words, the receiving portion 423 includes the communication port 4231. As shown in FIG. 5, the communication port 4231 is located at the center of the first wall 4232 in the first direction.

The receiving portion 423 is located between the first side frame 421 and the second side frame 422 in the first direction. The receiving portion 423 extends in the first direction. The receiving portion 423 extends in parallel with the axis 411 of the photosensitive drum 41K. One end of the receiving portion 423 in the first direction is connected to the first side frame 421. The internal space of the receiving portion 423 communicates with the hole 4213. An other end of the receiving portion 423 in the first direction is connected to the second side frame 422. The internal space of the receiving portion 423 communicates with the slit 4221 (see FIG. 6).

2.2 First Coupling 40K

In a state where the toner cartridge 5K is attached to the main housing 2, the first coupling 40K inputs driving force to a screw auger 54K. The screw auger 54K will be described later. In a state where the toner cartridge 5K is attached to the main housing 2, the first coupling 40K is connected to a second coupling 542 of the screw auger 54K. The first coupling 40K is provided at the second side frame 422. The first coupling 40K faces the internal space of the receiving portion 423.

2.3 Development Housing 46K

Figure 8:
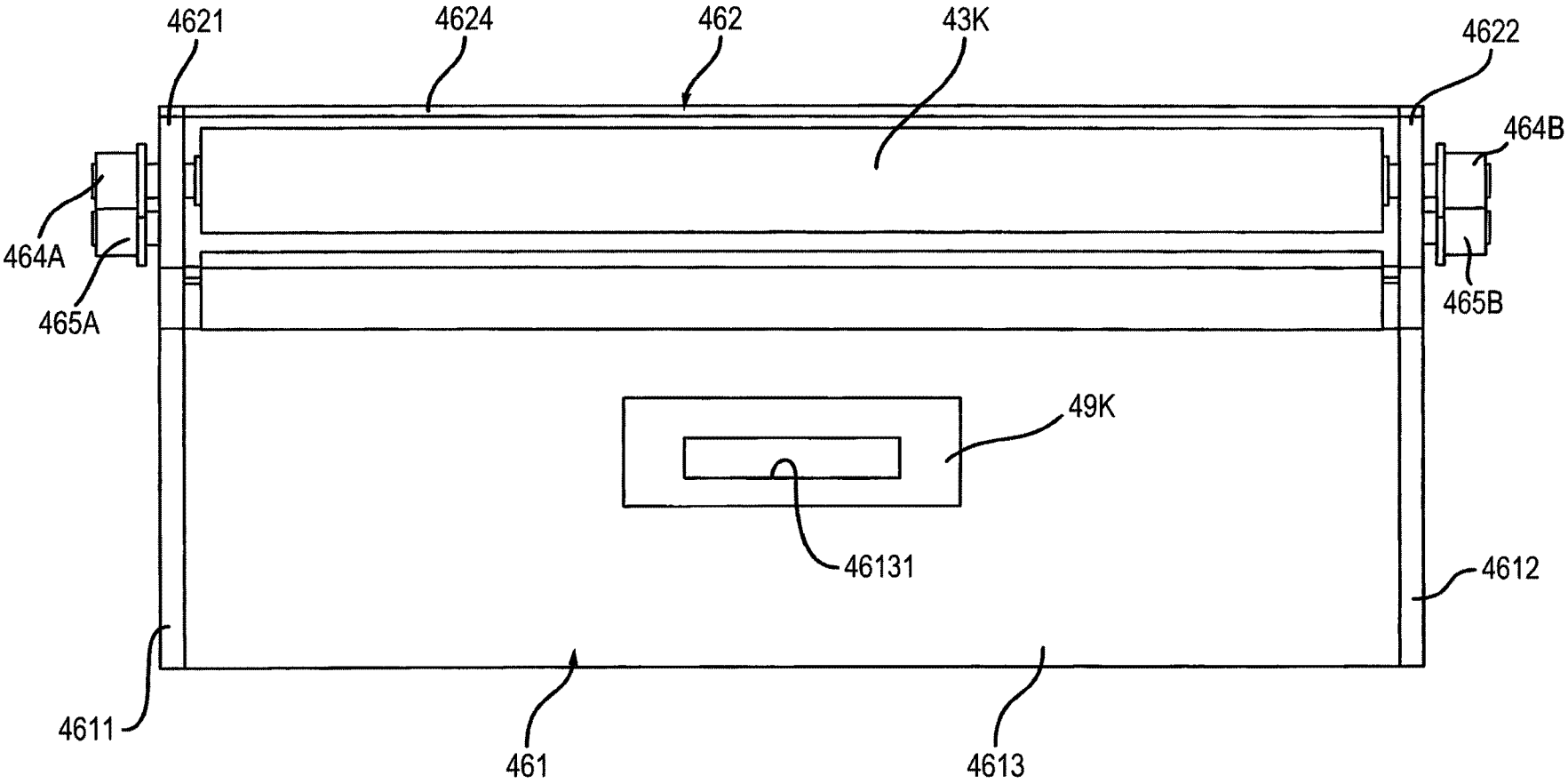
FIG. 8 is a front view of a development housing shown in FIG. 2.

As shown in FIG. 2, the development housing 46K includes the first development chamber 461, the second development chamber 462, a wall 463, two first protrusions 464A and 464B (see FIG. 8), and two second protrusions 465A and 465B (see FIG. 8).

2.3.1 First Development Chamber 461

The first development chamber 461 accommodates the agitator 45K. The first development chamber 461 faces the receiving portion 423 in the second direction.

As shown in FIG. 8, the first development chamber 461 includes a first side wall 4611, a second side wall 4612, and a connecting wall 4613.

The first side wall 4611 is located at one side in the first direction. The second side wall 4612 is located at the other side in the first direction. The second side wall 4612 is separated from the first side wall 4611 in the first direction.

The connecting wall 4613 connects the first side wall 4611 and the second side wall 4612 to each other. The connecting wall 4613 is located between the first side wall 4611 and the second side wall 4612 in the first direction. The connecting wall 4613 extends in the first direction. The connecting wall 4613 has a circular cylindrical shape (see FIG. 2). The connecting wall 4613 faces the first wall 4232 of the receiving portion 423 in the second direction (see FIG. 2).

The connecting wall 4613 includes a reception port 46131. In a state where the toner cartridge 5K is attached to the main housing 2, the reception port 46131 receives toner from the toner cartridge 5K. The reception port 46131 is located at the center of the connecting wall 4613 in the first direction. The reception port 46131 communicates with the communication port 4231 (see FIG. 2).

2.3.2 Second Development Chamber 462

In a state where the drum unit 4K is attached to the main housing 2, the second development chamber 462 is located above the first development chamber 461 (see FIG. 2). The second development chamber 462 accommodates the development roller 43K, the supply roller 44K, and the layer thickness regulating blade 400K (see FIG. 2).

The second development chamber 462 includes a third side wall 4621, a fourth side wall 4622, a bottom wall 4623 (see FIG. 2), and an upper wall 4624.

The third side wall 4621 is located at one side in the first direction. The third side wall 4621 is connected to the first side wall 4611. The third side wall 4621 rotatably supports one end of the development roller 43K in the first direction and one end of the supply roller 44K in the first direction.

The fourth side wall 4622 is located at the other side in the first direction. The fourth side wall 4622 is connected to the second side wall 4612. The fourth side wall 4622 is separated from the third side wall 4621 in the first direction. The fourth side wall 4622 rotatably supports the other end of the development roller 43K in the first direction and the other end of the supply roller 44K in the first direction.

As shown in FIG. 2, in a state where the drum unit 4K is attached to the main housing 2, the bottom wall 4623 is located between the development roller 43K and the receiving portion 423. The bottom wall 4623 connects the third side wall 4621 and the fourth side wall 4622 to each other in the first direction. The bottom wall 4623 supports the layer thickness regulating blade 400K.

The upper wall 4624 is located at the opposite side of the bottom wall 4623 with respect to the development roller 43K. The upper wall 4624 connects the third side wall 4621 and the fourth side wall 4622 to each other in the first direction.

2.3.3 Wall 463

The wall 463 is located at the opposite side of the photosensitive drum 41K with respect to the second development chamber 462. The wall 463 is located between the first development chamber 461 and the second development chamber 462. The wall 463 extends in the first direction. The wall 463 connects the third side wall 4621 and the fourth side wall 4622 to each other in the first direction. In a state where the drum unit 4K is attached to the main housing 2, an upper end of the wall 463 is separated by a certain interval from the upper wall 4624. In a state where the drum unit 4K is attached to the main housing 2, a lower end of the wall 463 is connected to the bottom wall 4623. The wall 463 forms an opening 4631 between the wall 463 and the upper wall 4624. The opening 4631 allows communication between the first development chamber 461 and the second development chamber 462.

2.3.4 Two First Protrusions 464A and 464B

Figure 7:
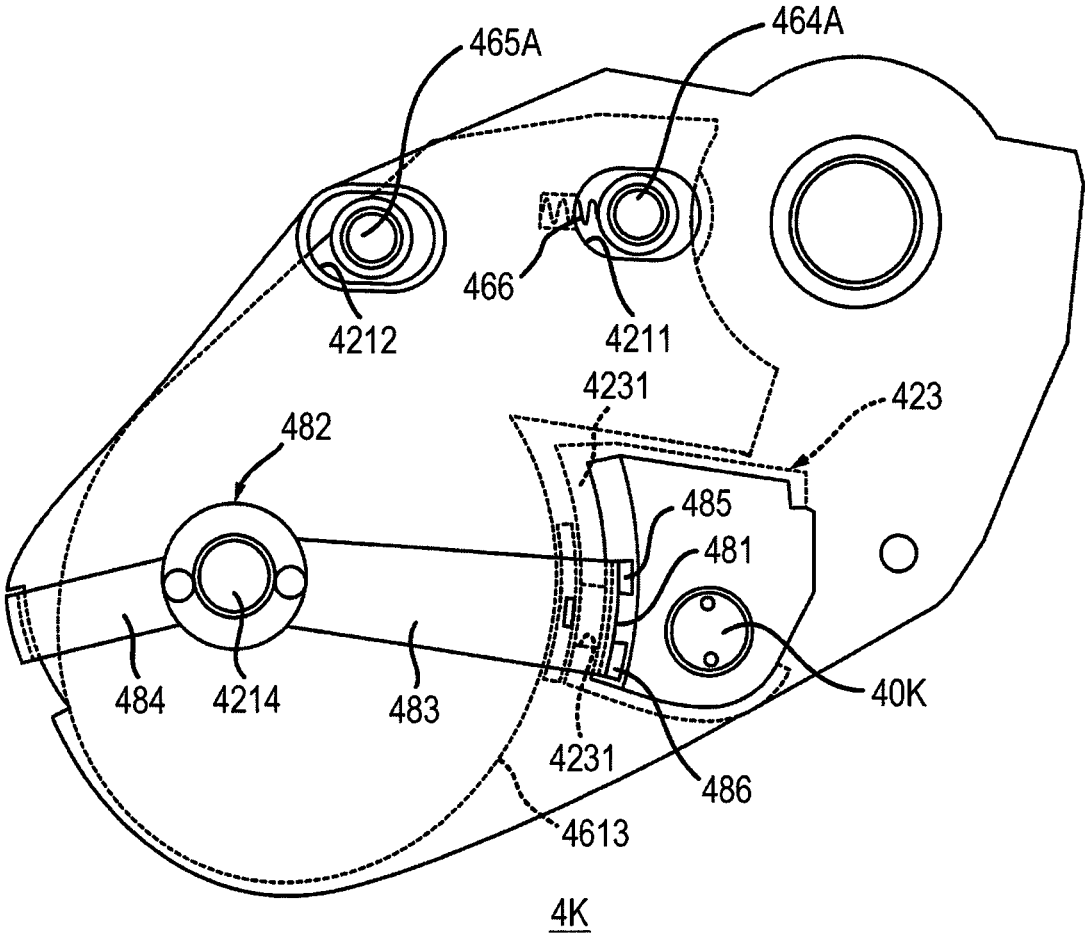
FIG. 7 is a side view of the drum unit shown in FIG. 4, showing a state where the development shutter is located at the development closed position.

As shown in FIGS. 6 and 7, the first protrusion 464A is located at the opposite side of the fourth side wall 4622 with respect to the third side wall 4621 in the first direction (see FIG. 8). The first protrusion 464A extends in the first direction. The first protrusion 464A has a circular columnar shape. The first protrusion 464A may be a shaft of the development roller 43K.

The first protrusion 464A fits in the first elongated hole 4211 of the first side frame 421. In a state where the first protrusion 464A is fitted in the first elongated hole 4211, play is provided in the first elongated hole 4211 in a direction in which the first elongated hole 4211 extends.

The first protrusion 464B is located at the opposite side of the third side wall 4621 with respect to the fourth side wall 4622 in the first direction (see FIG. 8). While not shown in the drawings, the first protrusion 464B fits in the first elongated hole 4211 of the second side frame 422. The description of the first protrusion 464A is applied in the same way to the first protrusion 464B. Thus, the description of the first protrusion 464B will be omitted.

2.3.5 Second Protrusions 465A and 465B

The second protrusion 465A is located at the opposite side of the fourth side wall 4622 with respect to the third side wall 4621 in the first direction (see FIG. 8). The second protrusion 465A extends in the first direction. The second protrusion 465A has a circular columnar shape.

The second protrusion 465A fits in the second elongated hole 4212 of the first side frame 421. The second protrusion 465A is located at the opposite side of the photosensitive drum 41K with respect to the first protrusion 464A in the second direction. In a state where the second protrusion 465A is fitted in the second elongated hole 4212, play is provided in the second elongated hole 4212 in a direction in which the second elongated hole 4212 extends.

The second protrusion 465B is located at the opposite side of the third side wall 4621 with respect to the fourth side wall 4622 in the first direction (see FIG. 8). While not shown in the drawings, the second protrusion 465B fits in the second elongated hole 4212 of the second side frame 422. The description of the second protrusion 465A is applied in the same way to the second protrusion 465B. Thus, the description of the second protrusion 465B will be omitted.

With this configuration, the development housing 46K is supported by the first side frame 421 and the second side frame 422. The development housing 46K is movable relative to the photosensitive drum 41K in a direction crossing the first direction. More specifically, the development housing 46K is movable relative to the photosensitive drum 41K in a direction in which the development roller 43K and the photosensitive drum 41K face each other. In other words, the drum frame 42K supports the development housing 46K such that the development housing 46K is movable relative to the photosensitive drum 41K.

The first protrusion 464A is pressed toward the photosensitive drum 41K by a spring 466. The spring 466 is located at the opposite side of the photosensitive drum 41K with respect to the first protrusion 464A. Thus, the development roller 43K is pressed toward the photosensitive drum 41K.

This reduces fluctuation of the contact state of the development roller 43K with the photosensitive drum 41K.

2.4 Agitator 45K

As shown in FIG. 2, the agitator 45K conveys toner in the first development chamber 461 toward the second development chamber 462. The agitator 45K is rotatably supported at the first development chamber 461. The agitator 45K includes a shaft 451 and a blade 452.

2.4.1 Shaft 451

The shaft 451 is rotatably supported at the first development chamber 461 of the development housing 46K. The shaft 451 extends in the first direction. One end of the shaft 451 in the first direction is supported by the first side wall 4611. The other end of the shaft 451 in the first direction is supported by the second side wall 4612.

2.4.2 Blade 452

The blade 452 is rotatable together with the shaft 451. The blade 452 has flexibility. The blade 452 has a first end 4521 and a second end 4522. The first end 4521 of the blade 452 is fixed to the shaft 451. The second end 4522 of the blade 452 is separated from the first end 4521. When the agitator 45K rotates, the second end 4522 of the blade 452 reaches the height of the opening 4631 in the vertical direction. In other words, the second end 4522 of the blade 452 reaches a higher position than the upper end of the wall 463 forming the opening 4631. Thus, in a state where the drum unit 4K is attached to the main housing 2, even if the second development chamber 462 accommodating the development roller 43K and the supply roller 44K is located at a higher position than the first development chamber 461, the agitator 45K still supplies toner stably from the first development chamber 461 to the second development chamber 462 through the opening 4631.

When the agitator 45K rotates, the second end 4522 of the blade 452 reaches a position above the bottom wall 4623 in the vertical direction. In a state where the second end 4522 reaches the height of the opening 4631, a part of the blade 452 between the first end 4521 and the second end 4522 passes through the opening 4631. In a state where the second end 4522 reaches the height of the opening 4631, the blade 452 has a height overlapping the supply roller 44K with respect to the vertical direction.

2.5 Development Shutter 48K

Figure 3:
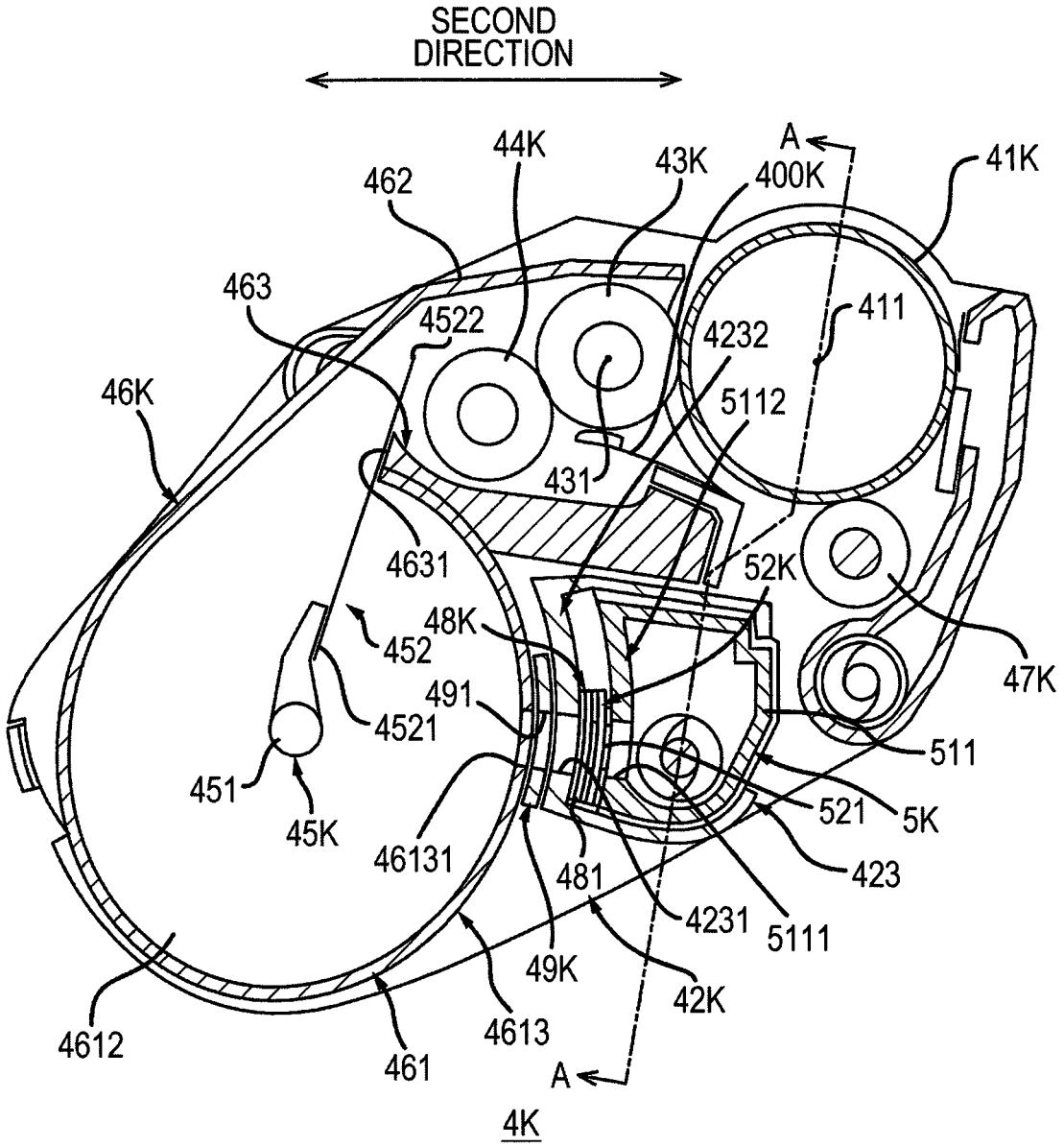
FIG. 3 is an enlarged view of the drum unit shown in FIG. 1, showing a state where a development shutter is located at a development closed position and the toner shutter is located at a toner closed position.

As shown in FIGS. 2 and 3, the development shutter 48K is movable between a development closed position (see FIG. 3) and a development open position (see FIG. 2).

In a state where the development shutter 48K is located at the development closed position, the development shutter 48K closes the reception port 46131 (see FIG. 3). More specifically, in a state where the development shutter 48K is located at the development closed position, the development shutter 48K closes the communication port 4231 communicating with the reception port 46131. Thus, by removing the toner cartridge 5K from the main housing 2 in a state where the development shutter 48K is located at the development closed position, the occurrence of leakage of toner from the drum unit 4K is suppressed.

In a state where the development shutter 48K is located at the development open position, the reception port 46131 is opened (see FIG. 2). More specifically, in a state where the development shutter 48K is located at the development open position, the communication port 4231 communicating with the reception port 46131 is opened.

As shown in FIG. 5, the development shutter 48K is rotatably supported by the drum frame 42K. The development shutter 48K includes a development shutter main body 481, a shutter coupling 482, a first arm 483, a second arm (not shown), a third arm 484, two ribs 485 and 486, and a protrusion 487.

2.5.1 Development Shutter Main Body 481

As shown in FIGS. 6 and 7, the development shutter main body 481 is located at the opposite side of the connecting wall 4613 with respect to the first wall 4232 of the receiving portion 423. The development shutter main body 481 is movable along the first wall 4232. The development shutter main body 481 has an arc-like shape extending along the first wall 4232.

As shown in FIG. 5, the development shutter main body 481 extends in the first direction. One end of the development shutter main body 481 in the first direction passes through the hole 4213 of the first side frame 421. The other end of the development shutter main body 481 in the first direction passes through the slit 4221 of the second side frame 422 (see FIG. 6).

In a state where the development shutter 48K is located at the development open position, the development shutter main body 481 is separated from the communication port 4231 (see FIG. 6). In a state where the development shutter 48K is located at the development closed position, the development shutter main body 481 overlaps the communication port 4231 in the second direction (see FIG. 7).

2.5.2 Shutter Coupling 482

In a state where the toner cartridge 5K is attached to the main housing 2, the shutter coupling 482 is connected to a lever coupling 533 (FIG. 9) of an operation lever 53K. The operation lever 53K will be described later. The shutter coupling 482 is located at the opposite side of the second side frame 422 with respect to the first side frame 421 in the first direction. The shutter coupling 482 includes a first annular part 4821, and two bosses 4822 and 4823.

The first annular part 4821 has a shape like a circular ring. The first boss 4214 of the first side frame 421 fits in the first annular part 4821.

The two bosses 4822 and 4823 are located at the opposite side of the first side frame 421 with respect to the first annular part 4821 in the first direction. Each of the two bosses 4822 and 4823 extends in the first direction from the first annular part 4821. Each of the two bosses 4822 and 4823 has a circular columnar shape. The two bosses 4822 and 4823 are arranged at an interval in a circumferential direction of the first annular part 4821.

While not shown in the drawings, the development shutter 48K further includes a second annular part. The second annular part is located at the opposite side of the first side frame 421 with respect to the second side frame 422 in the first direction. The first boss of the second side frame 422 fits in the second annular part.

2.5.3 First Arm 483 and Second Arm

The first arm 483 is located at the opposite side of the second side frame 422 with respect to the first side frame 421 in the first direction. The first arm 483 connects the one end of the development shutter main body 481 in the first direction and the first annular part 4821 to each other. While not shown in the drawings, the second arm is located at the opposite side of the first side frame 421 with respect to the second side frame 422 in the first direction. The second arm connects the other end of the development shutter main body 481 in the first direction and the second annular part to each other.

2.5.4 Third Arm 484

The third arm 484 is located at the opposite side of the first arm 483 with respect to the shutter coupling 482. The third arm 484 has a U-shape. One end of the third arm 484 is connected to the shutter coupling 482. While not shown in the drawings, the other end of the third arm 484 is connected to the second annular part.

2.5.5 Ribs 485 and 486

The two ribs 485 and 486 are provided at the development shutter main body 481. The two ribs 485 and 486 are located between the communication port 4231 and the second side frame 422 in the first direction. Each of the two ribs 485 and 486 protrudes in the second direction from the development shutter main body 481. The two ribs 485 and 486 are located at an interval therebetween in a direction in which the development shutter 48K moves. In a state where the toner cartridge 5K is attached to the main housing 2, a protrusion 522 of a toner shutter 52K fits in between the two ribs 485 and 486. The protrusion 522 will be described later.

2.5.6 Protrusion 487

The protrusion 487 is provided at the first arm 483. The protrusion 487 is located at the opposite side of the first side frame 421 with respect to the first arm 483 in the first direction. The protrusion 487 protrudes in the first direction from the first arm 483. In a state where the toner cartridge 5K is attached to the main housing 2, the protrusion 487 fits in a recessed part 523 (FIG. 9) of the toner shutter 52K.

2.6 Cushion Member 49K

As shown in FIG. 2, the cushion member 49K is located between the first development chamber 461 of the development housing 46K and the receiving portion 423 of the drum frame 42K. More specifically, the cushion member 49K is located between the connecting wall 4613 of the first development chamber 461 and the first wall 4232 of the receiving portion 423. The cushion member 49K allows the development housing 46K to move relative to the photosensitive drum 41K.

The cushion member 49K is made of a material having elasticity. In the present embodiment, the cushion member 49K is made of sponge. The cushion member 49K is located in a slightly compressed state between the connecting wall 4613 and the first wall 4232. The cushion member 49K may be attached adhesively to the connecting wall 4613 and/or the receiving portion 423 with a double-sided tape, for example.

When the development housing 46K moves relative to the photosensitive drum 41K, the cushion member 49K deforms elastically. More specifically, when the development housing 46K moves away from the photosensitive drum 41K, the connecting wall 4613 moves away from the receiving portion 423. Then, the cushion member 49K in the compressed state is restored to fill in the space between the connecting wall 4613 and the first wall 4232.

When the development housing 46K moves closer to the photosensitive drum 41K, the connecting wall 4613 moves closer to the receiving portion 423. Then, the cushion member 49K is compressed between the connecting wall 4613 and the first wall 4232.

The cushion member 49K surrounds the reception port 46131. The cushion member 49K surrounds the communication port 4231. The cushion member 49K includes an opening 491. The opening 491 allows communication between the reception port 46131 and the communication port 4231. Since the cushion member 49K surrounding the reception port 46131 contacts the connecting wall 4613 and the first wall 4232, the cushion member 49K seals between the connecting wall 4613 and the receiving portion 423. This suppresses the occurrence of leakage of toner from between the connecting wall 4613 of the development housing 46K and the receiving portion 423.

3. Detail of Toner Cartridge 5K

Figure 9:
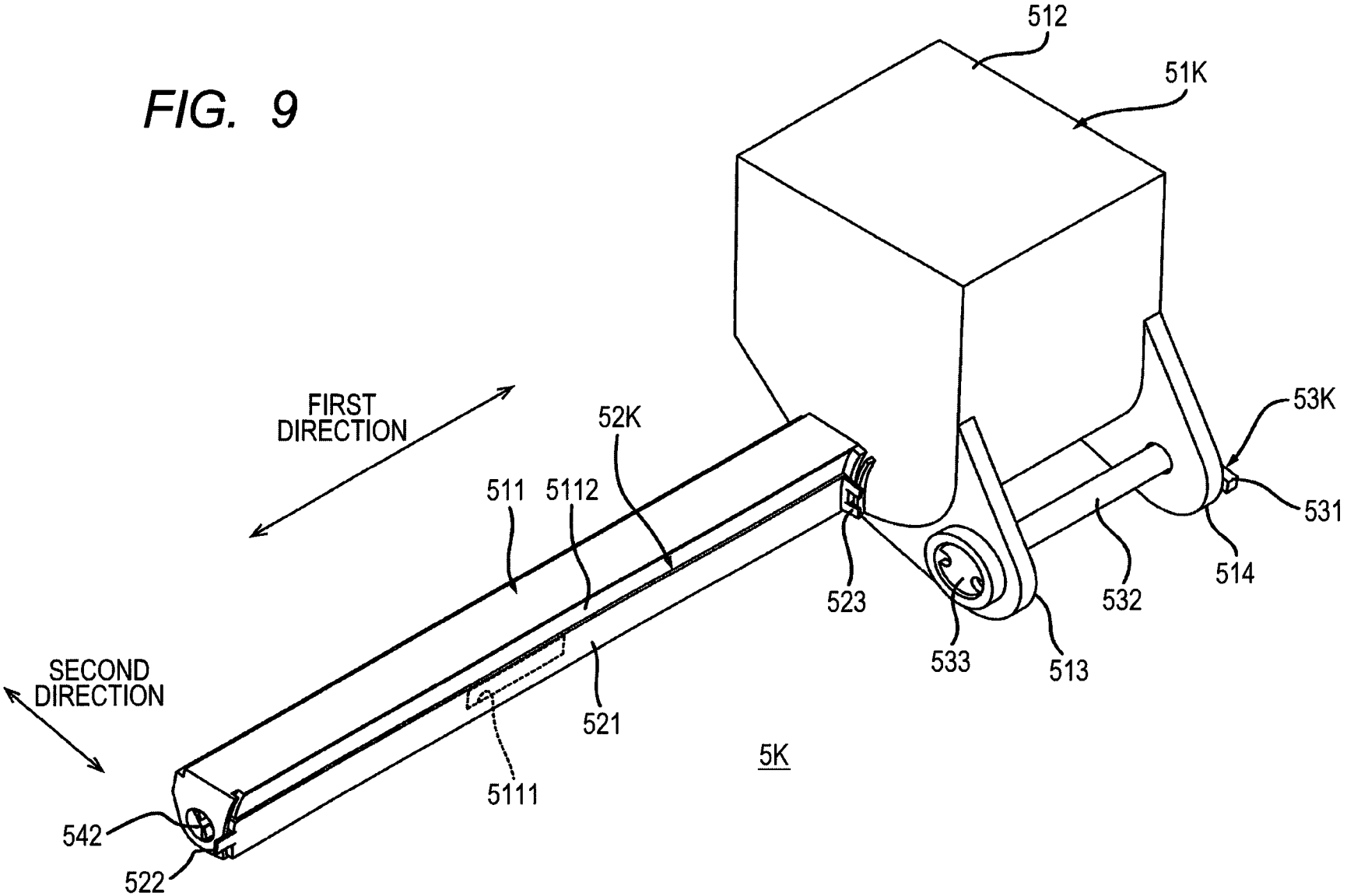
FIG. 9 shows a perspective view of a toner cartridge shown in FIG. 2.

As shown in FIG. 9, the toner cartridge 5K is attachable to the main housing 2 in the first direction. More specifically, in a state where the drum unit 4K is attached to the main housing 2, the toner cartridge 5K is attachable to the drum unit 4K in the first direction. This allows the toner cartridge 5K containing toner to be replaced separately from the drum unit 4K.

The toner cartridge 5K contains toner to be supplied to the first development chamber 461 of the development housing 46K. In a state where the toner cartridge 5K is attached to the drum unit 4K, the toner cartridge 5K is configured to supply the toner to the first development chamber 461 (see FIG. 2).

The toner cartridge 5K includes a cartridge housing 51K, the screw auger 54K (see FIG. 10), the toner shutter 52K, and the operation lever 53K.

3.1 Cartridge Housing 51K

The cartridge housing 51K is configured to contain toner. The cartridge housing 51K includes the first portion 511 and a second portion 512. In other words, the toner cartridge 5K includes the first portion 511 and the second portion 512.

3.1.1 First Portion 511

As shown in FIG. 2, in a state where the toner cartridge 5K is attached to the main housing 2, the first portion 511 of the toner cartridge 5K is arranged side by side with the first development chamber 461 of the development housing 46K in the second direction. In a state where the toner cartridge 5K is attached to the drum unit 4K, the first portion 511 fits in the receiving portion 423. In a state where the toner cartridge 5K is attached to the drum unit 4K, the first portion 511 is located at the opposite side of the connecting wall 4613 with respect to the first wall 4232 of the receiving portion 423 in the second direction.

Figure 10:
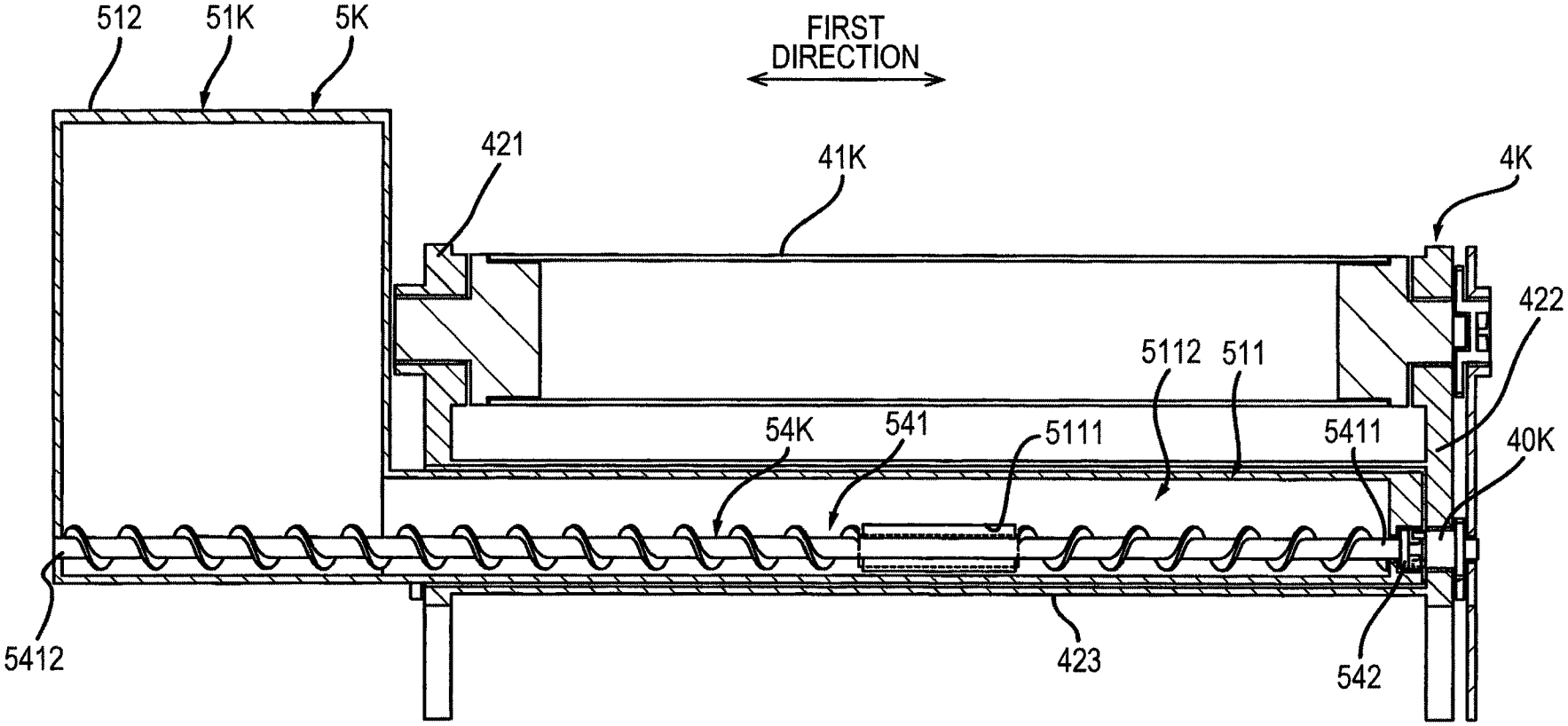
FIG. 10 is a cross-sectional view of the toner cartridge and the drum unit shown in FIG. 3, taken along a line A-A.

The first portion 511 extends in the first direction (see FIG. 9). The first portion 511 includes a second wall 5112. In a state where the first portion 511 is fitted in the receiving portion 423, the second wall 5112 faces the first wall 4232 of the receiving portion 423 in the second direction. The second wall 5112 has an arc-like shape extending along the first wall 4232. The second wall 5112 includes a supply port 5111. In other words, the first portion 511 includes the supply port 5111. In a state where the toner cartridge 5K is attached to the main housing 2, the supply port 5111 communicates with the reception port 46131 through the communication port 4231. In other words, the communication port 4231 allows communication between the reception port 46131 and the supply port 5111. As shown in FIG. 10, the supply port 5111 is located at the center of the second wall 5112 in the first direction.

3.1.2 Second Portion 512

In a state where the toner cartridge 5K is attached to the main housing 2, the second portion 512 of the toner cartridge 5K is arranged side by side with the drum unit 4K in the first direction. In a state where the toner cartridge 5K is attached to the main housing 2, the second portion 512 is located at the opposite side of the second side frame 422 with respect to the first side frame 421 and is arranged side by side with the photosensitive drum 41K in the first direction. In a state where the toner cartridge 5K is attached to the main housing 2, the second portion 512 overlaps the photosensitive drum 41K as viewed from the first direction. In a direction in which the toner cartridge 5K is attached, the second portion 512 is located upstream of the first portion 511.

The internal space of the second portion 512 communicates with the internal space of the first portion 511. The capacity of the second portion 512 is greater than that of the first portion 511. A projected area formed when the second portion 512 is projected in the first direction is greater than a projected area formed when the first portion 511 is projected in the first direction. This increases the capacity of the toner cartridge 5K, while reducing the size of the image forming apparatus 1 in the second direction.

As shown in FIG. 9, the second portion 512 has an outer surface provided with two lever supports 513 and 514. The two lever supports 513 and 514 support the operation lever 53K. The two lever supports 513 and 514 are located at an interval therebetween in the first direction. The lever support 514 is located at the opposite side of the first portion 511 with respect to the lever support 513 in the first direction. In the direction in which the toner cartridge 5K is attached, the lever support 514 is located upstream of the lever support 513.

3.2 Screw Auger 54K

As shown in FIG. 10, the screw auger 54K feeds toner in the first direction inside the cartridge housing 51K. The screw auger 54K is arranged at least partially in the first portion 511. In the present embodiment, the screw auger 54K is arranged to extend over the first portion 511 and the second portion 512. The screw auger 54K includes an auger main body 541 and the second coupling 542.

The auger main body 541 extends in the first direction. One end 5411 of the auger main body 541 in the first direction is supported by a side wall of the first portion 511. The other end 5412 of the auger main body 541 in the first direction is separated from the one end 5411 in the first direction and is supported by a side wall of the second portion 512. A part of the auger main body 541 between the other end 5412 and the supply port 5111 is used for feeding toner from the other end 5412 toward the supply port 5111. A part of the auger main body 541 between the supply port 5111 and the one end 5411 is used for feeding the toner from the one end 5411 toward the supply port 5111.

The second coupling 542 is provided at the one end 5411 of the auger main body 541. In a state where the first portion 511 is fitted in the receiving portion 423, the second coupling 542 is connected to the first coupling 40K. Thus, in a state where the first portion 511 is fitted in the receiving portion 423, driving force is input from the first coupling 40K to the screw auger 54K.

3.3 Toner Shutter 52K

As shown in FIGS. 2 and 3, the toner shutter 52K is movable between a toner closed position (see FIG. 3) and a toner open position (see FIG. 2). In a state where the toner shutter 52K is located at the toner closed position, the toner shutter 52K closes the supply port 5111 (see FIG. 3). Thus, by removing the toner cartridge 5K from the main housing 2 in a state where the toner shutter 52K is located at the toner closed position, the occurrence of leakage of toner from the toner cartridge 5K is suppressed.

In a state where the toner shutter 52K is located at the toner open position, the supply port 5111 is opened (see FIG. 2).

In a state where the toner cartridge 5K is attached to the main housing 2, the toner shutter 52K moves in conjunction with the development shutter 48K. Thus, in a state where the development shutter 48K is located at the development closed position, the toner shutter 52K is located at the toner closed position. In a state where the development shutter 48K is located at the development open position, the toner shutter 52K is located at the toner open position. In a state where the toner cartridge 5K is attached to the main housing 2 and the development shutter 48K is located at the development open position and the toner shutter 52K is located at the toner open position, the supply port 5111, the communication port 4231, and the reception port 46131 communicate with each other. This allows toner to be supplied from the first portion 511 of the toner cartridge 5K to the first development chamber 461 of the development housing 46K through the supply port 5111, the communication port 4231, and the reception port 46131.

As shown in FIG. 9, the toner shutter 52K includes a toner shutter main body 521, a protrusion 522, and a recessed part 523.

3.3.1 Toner Shutter Main Body 521

The toner shutter main body 521 is movable along the second wall 5112. The toner shutter main body 521 has an arc-like shape extending along the second wall 5112.

The toner shutter main body 521 extends in the first direction. In a state where the toner shutter 52K is located at the toner open position, the toner shutter main body 521 is separated from the supply port 5111 (see FIG. 2). In a state where the toner shutter 52K is located at the toner closed position, the toner shutter 52K overlaps the supply port 5111 in the second direction (see FIG. 3).

3.3.2 Protrusion 522

The protrusion 522 is provided at one end of the toner shutter main body 521 in the first direction. The protrusion 522 protrudes in the first direction from the toner shutter main body 521. In a state where the toner cartridge 5K is attached to the main housing 2, the protrusion 522 fits in between two ribs 485 and 486 of the development shutter 48K (see FIG. 5).

3.3.3 Recessed Part 523

The recessed part 523 is provided at the other end of the toner shutter main body 521 in the first direction. The recessed part 523 is located at the opposite side of the second wall 5112 with respect to the toner shutter main body 521 in the second direction. The recessed part 523 protrudes in the second direction from the toner shutter main body 521. In a state where the toner cartridge 5K is attached to the main housing 2, the recessed part 523 receives the protrusion 487 of the development shutter 48K. Thus, in a state where the toner cartridge 5K is attached to the main housing 2, the toner shutter 52K is connected to the development shutter 48K.

3.4 Operation Lever 53K

The operation lever 53K is used for operating the development shutter 48K. The operation lever 53K is supported by the second portion 512. More specifically, the operation lever 53K is supported by the two lever supports 513 and 514 provided at the second portion 512. This improves the operability of the operation lever 53K compared with a case where the operation lever 53K is supported by the first portion 511.

Figure 11:
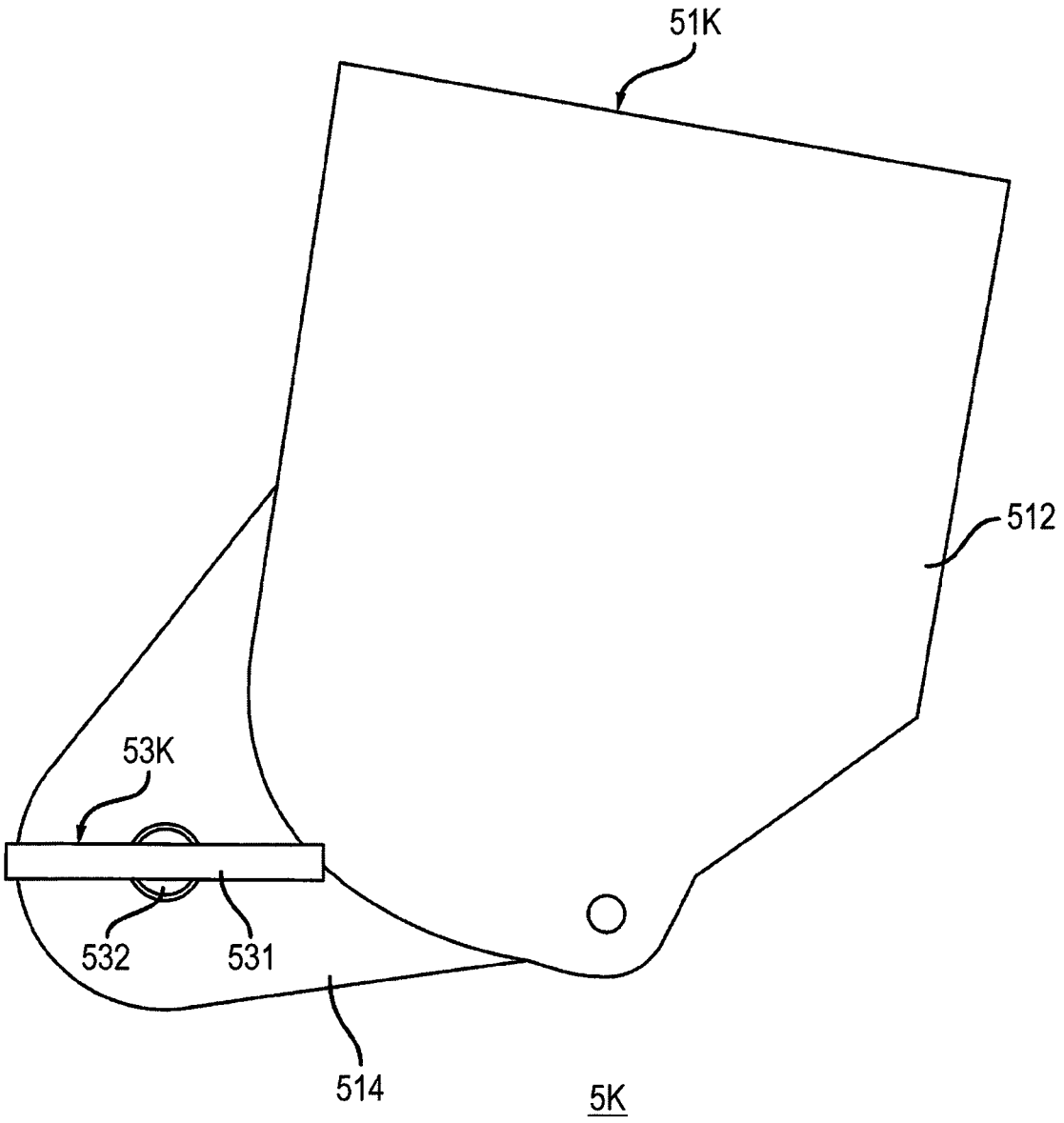
FIG. 11 shows one side view of the toner cartridge shown in FIG. 9.
Figure 12:
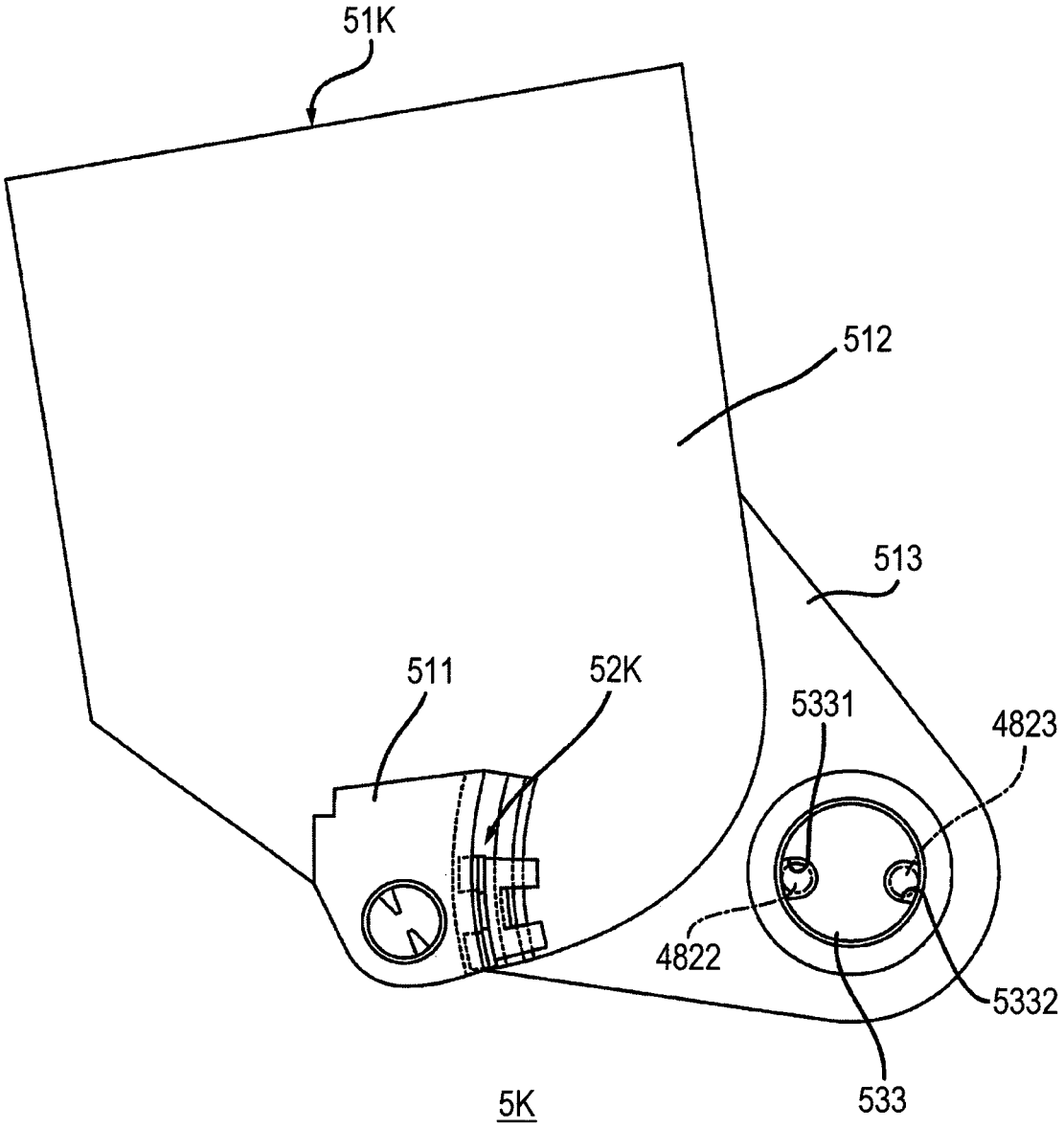
FIG. 12 shows another side view of the toner cartridge shown in FIG. 9.

As shown in FIGS. 11 and 12, the operation lever 53K includes a shaft 532, a handle 531, and the lever coupling 533.

The shaft 532 extends in the first direction. The shaft 532 is rotatably supported by the two lever supports 513 and 514.

The handle 531 is operated by a user. The handle 531 is located at the opposite side of the lever support 513 with respect to the lever support 514 in the first direction. The handle 531 is fixed to the shaft 532.

In a state where the toner cartridge 5K is attached to the main housing 2, the lever coupling 533 is connected to the shutter coupling 482. The lever coupling 533 is located at the opposite side of the lever support 514 with respect to the lever support 513 in the first direction. The lever coupling 533 is fixed to the shaft 532. The lever coupling 533 has a shape like a circular plate. The lever coupling 533 includes two recesses (grooves) 5331 and 5332. The two recesses 5331 and 5332 are located at an interval therebetween in a circumferential direction of the lever coupling 533.

In a state where the toner cartridge 5K is attached to the main housing 2, the boss 4822 of the development shutter 48K fits in the recess 5331 and the boss 4823 of the development shutter 48K fits in the recess 5332.

Thus, in a state where the toner cartridge 5K is attached to the main housing 2, the operation lever 53K is connected to the development shutter 48K. As described above, in a state where the toner cartridge 5K is attached to the main housing 2, the toner shutter 52K is connected to the development shutter 48K. This allows a user to move the toner shutter 52K and the development shutter 48K integrally by operating the operation lever 53K while holding the handle 531.

4. Operations and Effects

As shown in FIG. 10, in the image forming apparatus 1, the toner cartridge 5K containing toner is removed from the main housing 2 separately from the drum unit 4K including the photosensitive drum 41K. Thus, the toner cartridge 5K is replaced separately from the drum unit 4K.

As shown in FIG. 2, when the agitator 45K accommodated in the first development chamber 461 rotates, the second end 4522 of the blade 452 reaches the height of the opening 4631 in the vertical direction. Thus, although the second development chamber 462 accommodating the development roller 43K and the supply roller 44K is located above the first development chamber 461 in a state where the drum unit 4K is attached to the main housing 2, the agitator 45K stably supplies toner from the first development chamber 461 to the second development chamber 462 through the opening 4631.

While the disclosure has been described in detail with reference to the above aspects thereof, it would be apparent to those skilled in the art that various changes and modifications may be made therein without departing from the scope of the claims.

What is claimed is:

1. An image forming apparatus comprising:

a main housing;

a drum unit attachable to the main housing, the drum unit including:

a photosensitive drum rotatable about an axis extending in a first direction;

a development roller;

a supply roller;

an agitator; and a development housing having a first development chamber and a second development chamber, the development housing including a wall having an opening, the first development chamber and the second development chamber being in communication with each other through the opening, the first development chamber accommodating the agitator, the second development chamber accommodating the development roller and the supply roller, the second development chamber being located above the first development chamber;

a toner cartridge configured to contain toner to be supplied to the first development chamber of the development housing, the toner cartridge being attachable to the main housing; and a transfer device located above the photosensitive drum in a state where the drum unit is attached to the main housing, the transfer device being configured to transfer toner on the photosensitive drum to a sheet, the agitator including:

a shaft rotatably supported by the development housing; and a blade rotatable together with the shaft, the blade having a first end fixed to the shaft and a second end located away from the first end, the agitator being configured such that, when rotated, the second end of the blade reaches a height of the opening in a vertical direction, wherein the development housing defining the first development chamber includes:

a first side wall located at one side in the first direction;

a second side wall located at an other side in the first direction; and a connection wall connecting the first side wall and the second side wall, the connection wall having a reception port configured to receive toner from the toner cartridge;

wherein the reception port is located at a center of the connection wall in the first direction; and wherein the toner cartridge includes:

a first portion overlapping the first development chamber of the development housing in a second direction crossing the first direction in a state where the toner cartridge is attached to the main housing; and a second portion overlapping the drum unit in the first direction in a state where the toner cartridge is attached to the main housing.

2. The image forming apparatus according to claim 1, wherein a capacity of the second portion is greater than a capacity of the first portion.

3. The image forming apparatus according to claim 1, wherein the toner cartridge further includes a screw auger arranged in the first portion, the screw auger being configured to feed toner in the first direction.

4. The image forming apparatus according to claim 1, wherein the drum unit further includes a drum frame supporting the development housing such that the development housing is movable relative to the photosensitive drum.

5. The image forming apparatus according to claim 4, wherein the first portion has a supply port in communication with the reception port in a state where the toner cartridge is attached to the main housing; and wherein the drum frame has a receiving portion configured to receive the first portion when the toner cartridge is attached to the main housing, the receiving portion having a communication port through which the reception port and the supply port communicate with each other.

6. The image forming apparatus according to claim 5, wherein the drum unit further includes a cushion member surrounding the reception port, the cushion member being located between the development housing and the receiving portion, the cushion member allowing the development housing to move relative to the photosensitive drum.

7. The image forming apparatus according to claim 1, wherein the first portion has a supply port in communication with the reception port in a state where the toner cartridge is attached to the main housing.

8. The image forming apparatus according to claim 7, wherein the toner cartridge further includes a toner shutter movable between a toner closed position at which the supply port is closed and a toner open position at which the supply port is open.

9. The image forming apparatus according to claim 8, wherein the drum unit further includes a development shutter movable between a development closed position at which the reception port is closed and a development open position at which the reception port is open.

10. The image forming apparatus according to claim 9, wherein the toner shutter is configured to move in conjunction with the development shutter in a state where the toner cartridge is attached to the main housing;

wherein the toner shutter is located at the toner closed position in a state where the development shutter is located at the development closed position; and wherein the toner shutter is located at the toner open position in a state where the development shutter is located at the development open position.

11. The image forming apparatus according to claim 10, wherein the toner cartridge is attachable to the main housing along the first direction; and wherein the second portion is located upstream of the first portion in an attachment direction in which the toner cartridge is attached.

12. The image forming apparatus according to claim 11, wherein the toner cartridge includes an operation lever for operating the development shutter, the operation lever being supported by the second portion.

13. The image forming apparatus according to claim 12, wherein, in a state where the toner cartridge is attached to the main housing, the operation lever is connected to the development shutter and the toner shutter is connected to the development shutter.

14. An image forming apparatus comprising:

a main housing;

a drum unit attachable to the main housing, the drum unit including:

a photosensitive drum rotatable about an axis extending in a first direction;

a development roller;

a supply roller; and a development housing having a first development chamber and a second development chamber, the development housing including a wall having an opening, the first development chamber and the second development chamber being in communication with each other through the opening, the second development chamber accommodating the development roller and the supply roller, the second development chamber being located above the first development chamber;

a toner cartridge configured to contain toner to be supplied to the first development chamber of the development housing, the toner cartridge being attachable to the main housing; and a transfer device located above the photosensitive drum in a state where the drum unit is attached to the main housing, the transfer device being configured to transfer toner on the photosensitive drum to a sheet, wherein the development housing defining the first development chamber includes:

a first side wall located at one side in the first direction;

a second side wall located at an other side in the first direction; and a connection wall connecting the first side wall and the second side wall, the connection wall having a reception port configured to receive toner from the toner cartridge;

wherein the reception port is located at a center of the connection wall in the first direction; and wherein the toner cartridge includes:

a first portion overlapping the first development chamber of the development housing in a second direction crossing the first direction in a state where the toner cartridge is attached to the main housing; and a second portion overlapping the drum unit in the first direction in a state where the toner cartridge is attached to the main housing.

* * * * *